US007181794B2

(12) United States Patent
Diaz

(10) Patent No.: US 7,181,794 B2
(45) Date of Patent: Feb. 27, 2007

(54) FIRE-RETARDANT MATTRESS

(76) Inventor: Vincent Diaz, 2303 Tide Circle, Havre de Grace, MD (US) 21078

( * ) Notice: Subject to any disclaimer, the term of this patent is extended or adjusted under 35 U.S.C. 154(b) by 158 days.

(21) Appl. No.: 11/096,290

(22) Filed: Apr. 1, 2005

(65) Prior Publication Data

US 2005/0183202 A1 Aug. 25, 2005

Related U.S. Application Data

(63) Continuation-in-part of application No. 10/455,669, filed on Jun. 5, 2003, now Pat. No. 6,954,956, which is a continuation-in-part of application No. 10/261,895, filed on Oct. 1, 2002, now Pat. No. 6,718,583.

(51) Int. Cl.
*A47C 27/00* (2006.01)
*A47C 27/22* (2006.01)

(52) U.S. Cl. ..... 5/698; 5/737; 5/739; 29/91.1; 29/91.6

(58) Field of Classification Search ..... 5/698, 5/737, 739; 29/91, 91.1, 91.6; 297/DIG. 5
See application file for complete search history.

(56) References Cited

U.S. PATENT DOCUMENTS 3,818,521 A * 6/1974 Richards, Jr. ..... 5/698
3,857,126 A * 12/1974 Woodruff ..... 5/698
4,430,765 A * 2/1984 Karpen ..... 5/698
4,504,991 A * 3/1985 Klancnik ..... 5/698
5,475,881 A * 12/1995 Higgins et al. ..... 5/737
6,609,261 B1 * 8/2003 Mortensen et al. ..... 5/698
6,718,583 B1 * 4/2004 Diaz ..... 5/698
6,954,956 B1 * 10/2005 Diaz ..... 5/698
6,994,043 B1 * 2/2006 Price ..... 112/475.08

* cited by examiner

*Primary Examiner*—Michael Trettel
(74) *Attorney, Agent, or Firm*—Armstrong, Kratz, Quintos, Hanson & Brooks, LLP

(57) ABSTRACT

A fire retardant pillow top mattress has a base which is covered by a fire barrier material. A ticking covers the fire barrier material. Sheets of these combined materials are formed into a top, a bottom and sidewalls for the mattress. In a pillow top mattress, the pillow top and the gusset between the mattress and the pillow top are formed in a like manner. The intersecting planar surfaces are mated between a flame-retardant treated edge binding tape. The mated surfaces are sewn with a flame retardant thread and the mattress, pillow top and gusset are encapsulated with fire retardant components. The edges of the sidewalls and the mattress cover are serge stitched with a flame retardant thread.

4 Claims, 9 Drawing Sheets

FIRE-RETARDANT MATTRESS

CROSS REFERENCE TO RELATED APPLICATIONS

This application is a continuation-in-part of application Ser. No. 10/455,669 filed Jun. 5, 2003 (now U.S. Pat. No. 6,954,956, issued Oct. 18, 2005), which is a continuation-in-part of application Ser. No. 10/261,895 filed Oct. 1, 2002 (now U.S. Pat. No. 6,718,583 issued Apr. 13, 2004), the disclosure of which is incorporated by reference herein in their entireties.

BACKGROUND OF THE INVENTION

1. Field of the Invention

The present invention relates to a mattress which is fire-retardant and does not burn when exposed to elevated temperatures and flame.

2. Description of Related Art

In the United States mattress fires cause the deaths of approximately 500 people each year. One of the main causes of these fires is children playing with matches.

The incidence of mattress fires throughout the United States is such that the industry has formed committees to attempt to establish standards for testing flammability of mattresses. The state of California enacted Assembly Bill 603(AB603) in 2001 which requires all mattresses to be sold effective January 2004 to meet the performance requirements of California Technical Bulletin 129 and subsequently California Technical Bulletin 603(TB603). The Consumer Product Safety Commission is considering regulations which would require that mattresses be required to pass an open flame test which would be mandatory nationwide.

The foam, used within the mattress for cushioning, is a potential source of fuel which can be ignited and quickly engulf the mattress in flames. The foam is highly flammable. Not only is the foam flammable, but when burning, it emits noxious fumes. Furthermore, in the construction of the mattress, the sewing thread, used to secure the perimeter of the mattress, is a thread made of nylon or other fibers. These threads are flammable and will melt when exposed to direct flame. The flammability of the present mattresses is aggravated by these types of thread. These threads melt at the temperature of a burning match, which is approximately 460° F. When the thread is destroyed the structural integrity of the mattress is destroyed. The flame frequently travels around the periphery of the mattress where the threads join the top and the sidewalls. This flame then ignites the foam within the mattress which fuels the fire to a catastrophic event.

There is interest from the ASTM International, a national consensus standards organization, on this subject. Specifically, Subcommittees E5.15 which is responsible for household furnishings and D13.52 which is responsible for flammability of textiles, have initiated the development of a standard to evaluate the performance of components which can be used to improve the ability of mattresses to withstand an open flame.

In a related area, aircraft seat manufacturers are concerned about the flame resistance of the seats to meet the performance requirements of Federal Aviation Regulations (FAR) 25.833.

BRIEF SUMMARY OF THE INVENTION

It is an object of the present invention to provide a mattress, a sofa cushion and a pillow which, when exposed to an open flame, will not burn.

It is a further object of the present invention to provide a fire retardant mattress which is easily produced and is economical to manufacture.

It is another object of the present invention to provide a fire retardant mattress which will meet the requirements established by government agencies.

It is still another object of the current invention to provide a fire retardant pillow mattress which additionally protects the gusset around the mattress.

In accordance with the teachings of the present invention, there is disclosed a system for a fire retardant mattress having a foam base, a fire barrier material substantially covering the foam base, a ticking covering the fire barrier material, and a fire retardant tape forming an edge binding for the mattress around the perimeter thereof. The fire barrier material is sandwiched between the edge binding, thereby forming a laterally-projecting flange. The flange is held together by a stitched flame retardant sewing thread. The thread and the tape of the edge binding are capable of withstanding very high temperatures without rendering the foam vulnerable to the flames, and yet retaining the structural integrity of the mattress as a whole. The foam base is attached to the fire barrier material and is sandwiched between the edge binding together with the fire barrier material forming the laterally-projecting flange. The foam base, the fire barrier material and the ticking each have an outer perimeter edge. The outer perimeter edges of the foam base, the fire barrier material and the ticking respectively are bound together by a serge stitching. The serge stitching is formed from a flame retardant sewing thread. In this manner, the foam base, which is flammable, is protected from exposure to an open flame by the system of the fire barrier material, the fire retardant tape, the flame retardant sewing thread and the serge stitching formed from the flame retardant sewing thread.

In further accord with the teachings of the present invention, there is disclosed a method of making a fire retardant mattress. A foam base is provided forming a mattress member. There is also provided a fire barrier material, a flammable foam interiorly adjacent to the fire barrier material and a ticking exteriorly covering the fire barrier material thereby forming a sheet of material. The sheet of material has an outer perimeter edge. A flame retardant sewing thread is provided. The outer perimeter edge of the sheet of material is serge stitched with the flame retardant sewing thread. The sheet of material is formed into a cover for the mattress member and into sidewalls for encircling the mattress member. A treated fire retardant tape is provided. An edge of the sidewall is mated with the outer perimeter edge of the sheet of material. The mated edge having the foam compressed therebetween is covered with the treated fire retardant tape. The covered mated edges are secured with the flame retardant sewing thread. In this manner the entire mattress is covered with the fire barrier material and all joined and mated edges are secured with the flame retardant sewing thread such that the foam base is protected from exposure to flame.

These and other objects of the present invention will become apparent from a reading of the following specification taken in conjunction with the enclosed drawings.

DESCRIPTION OF THE PREFERRED EMBODIMENTS

Figure 1:
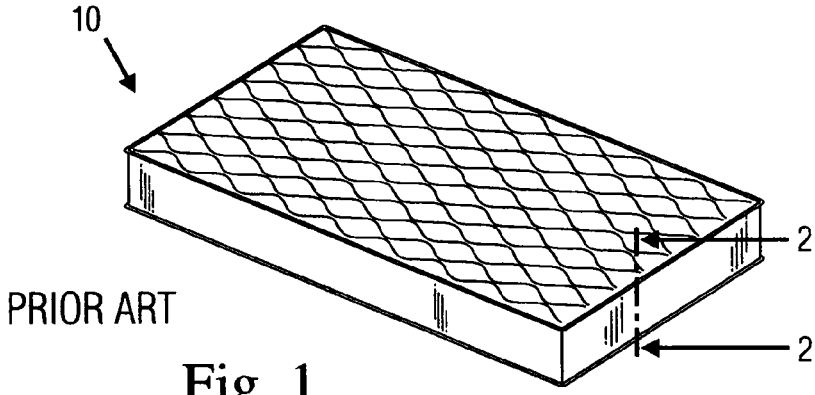
PRIOR ART Fig. 1
FIG. 1 is a perspective view of a mattress of the prior art.
Figure 2:
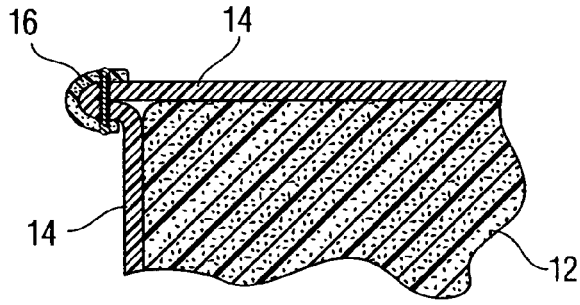
Fig. 2 PRIOR ART
FIG. 2 is a cross-sectional view taken across the lines 2—2 of FIG. 1.
Figure 3:
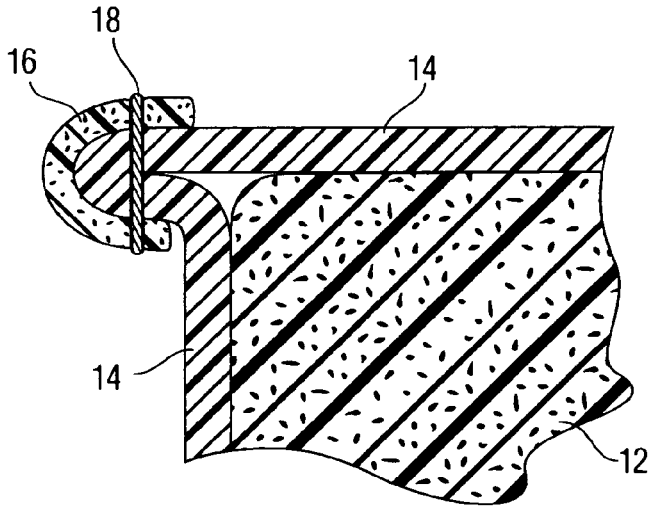
Fig. 3 PRIOR ART
FIG. 3 is an enlarged view of two intersecting planar surfaces of the mattress of FIG. 2.

Referring to FIGS. 1–4 in the prior art, a mattress 10 is formed by placing a flammable foam material 12 over a frame, usually having springs on the frame. A ticking 14 or dress cover fabric is made as a cover directly attached to the foam 12. The mattress 10 has a top, a bottom and four sidewalls connecting the top and bottom. These sidewalls intersect the perimeters of the planar top and bottom surfaces. At the intersection, the respective ticking are sandwiched between an edge binding 16 which encompasses the entire top perimeter. A similar edge binding 16 encompasses the entire bottom perimeter. The edge binding is sewn together to assemble the mattress.

Figure 4:
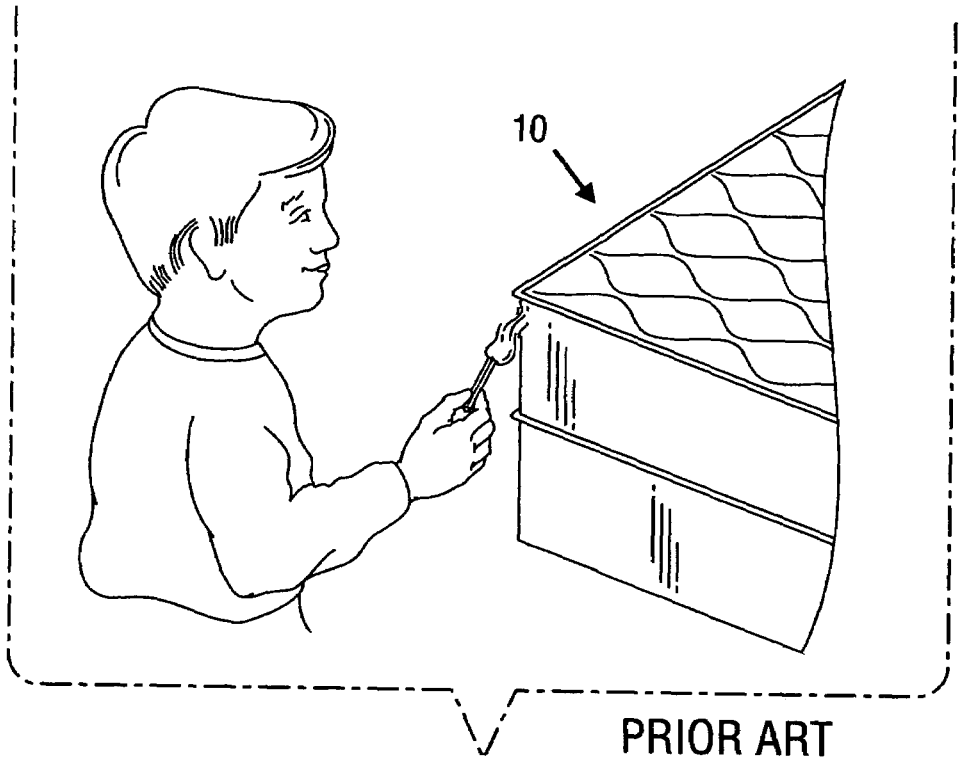
FIG. 4 is a diagram of ignition of the mattress of the prior art by a child playing with matches.

In the prior art, the ticking 14 is usually a polypropylene, polyester or nylon fabric. The edge binding 16 is generally made from an untreated polyester material. The edge binding and ticking are sewn together using a polymeric thread 18. None of the component materials are usually made from fire retardant or flame resistant material. When exposed to elevated temperatures or an open flame, all of the components will burn or melt to fuel the fire and/or to deform and no longer retain the shape of the mattress. One of the major causes of mattress fires is children playing with matches (FIG. 4).

Figure 5:
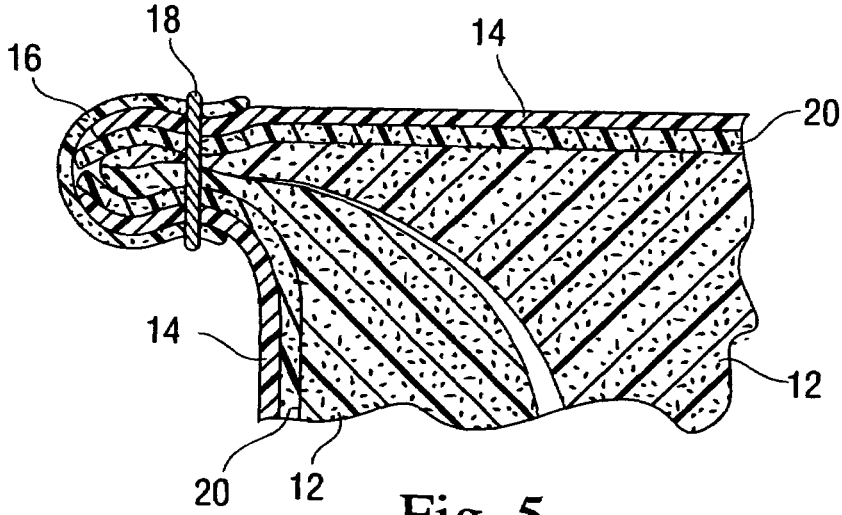
FIG. 5 is a cross-sectional view of the two intersecting planar surfaces of the mattress of the present invention.

In the present invention, FIG. 5, the ticking 14 is attached to a first face of a fire barrier material 20. A preferred fire barrier material is an aramid fiber which is made by E. I. DuPont de Nemours & Co. and sold as KEVLAR®. Other known fire barrier materials which are known are preoxidized acrylic and fiberglass. The acrylic material and the fiberglass are both uncomfortable on the skin of persons and are less desirable for use in mattresses. The ticking 14 is preferably sewn to the fire barrier material 20. On the opposite face of the fire barrier material 20, the foam 12 is attached. The fire barrier material 20 preferably has a weight ranging from 2 oz./sq. yd. to 5 oz./sq. yd. This defines a thickness of the fire barrier material 20 which can withstand an open flame for a sufficient time to be considered to provide a fire retardant mattress.

Figure 6:
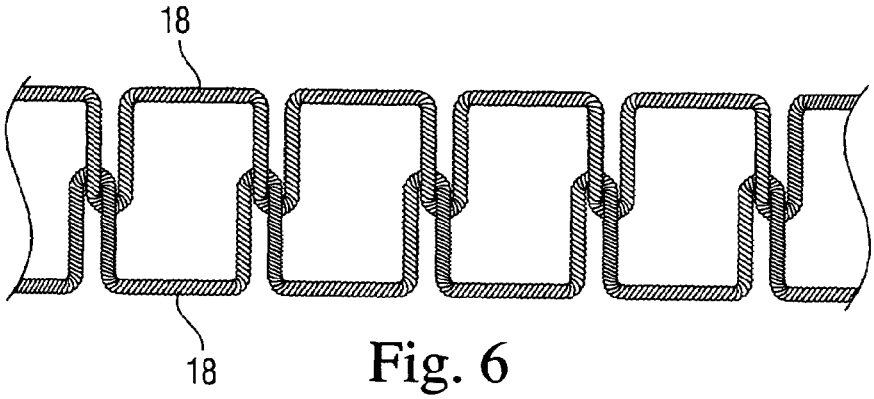
FIG. 6 is a diagrammatic view of a chain stitch.
Figure 7:
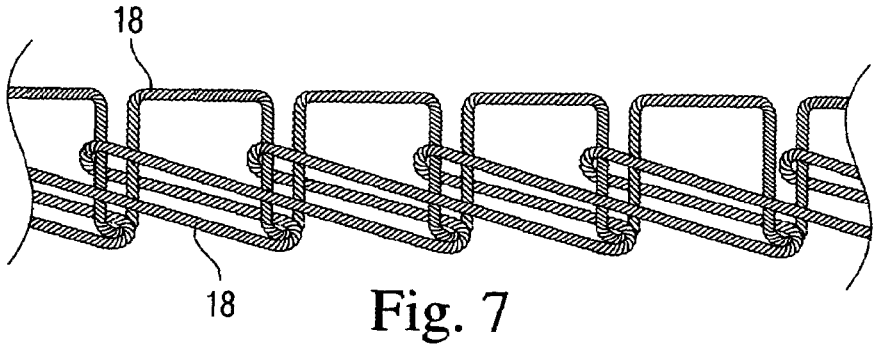
FIG. 7 is a diagrammatic view of a lock stitch.

The top and bottom of the mattress 10 are usually made, using much thicker foam 12. The sidewalls 22 of the mattress usually have a thinner foam. The sidewalls intersect the perimeters of the top and bottom surfaces of the mattress. At the intersection, as shown in FIG. 5, the foam 12 layer of the outer edges of the top (and the bottom) are placed adjacent to the foam 12 layer of the sidewall. The respective ticking 14 of the top (and the bottom) are disposed distal from the ticking on the sidewalls. The edges are sandwiched between the folded edge binding tapes 16 which encompass the entire perimeter of the top and the bottom of the mattress 10. The foam 12 layers are compressed within the folded edge binding tapes 16 and the edge binding tapes are sewn with a thread 18 preferably using a lock stitch or a chain stitch (FIGS. 6–7) in accordance with stitch type 301 or 401 of ASTMD6193.

The edge binding tape 16 of the present invention preferably is a polyester material which is treated for flame retardancy. The treated tape can also withstand washing.

The thread 18 of the present invention preferably is formed from material which is flame resistant such as aramid fiber. CRAQ-SPUN® sewing threads made of aramid fibers provided by Atlantic Thread and Supply Co., Inc. has been used successfully as the thread. The thickness of the thread may be selected for strength and cost. It is possible to use one thickness of thread in the needle thread of the sewing machine and a different thickness of thread in the bottom thread of the sewing machine. By a proper selection of thread thickness, the overall strength of the seam can be adjusted. The strength of the seam is an important factor because the foam portion of the top (and bottom layer) is very thick and is highly compressed when sandwiched in the edge binding 16 with the thinner layer of foam from the sidewalls. The thread 18 must be strong enough to resist the stress of the compressed foam 12, the fire barrier material 20 and the ticking 14 which are all sandwiched in the folded edge binding 16.

Figure 8:
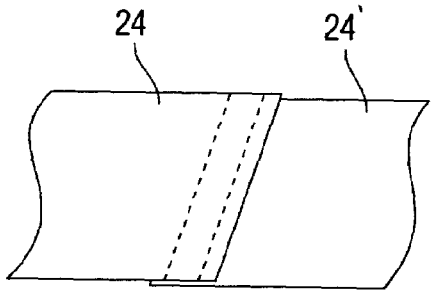
FIG. 8 is a perspective view of overlapping ends.
Figure 9:
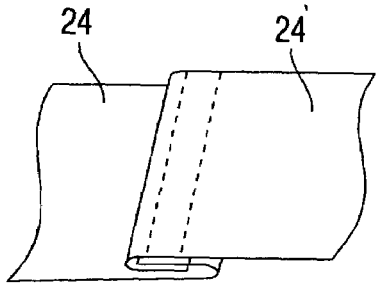
FIG. 9 is a perspective view of another embodiment of overlapping ends.
Figure 10:
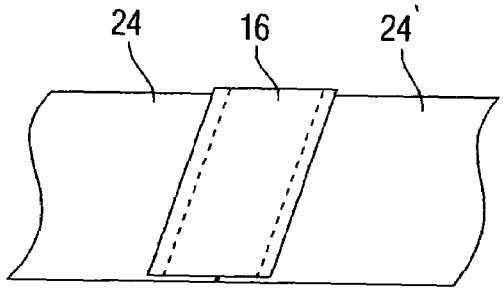
FIG. 10 is perspective view of a further embodiment of overlapping ends.
Figure 20:
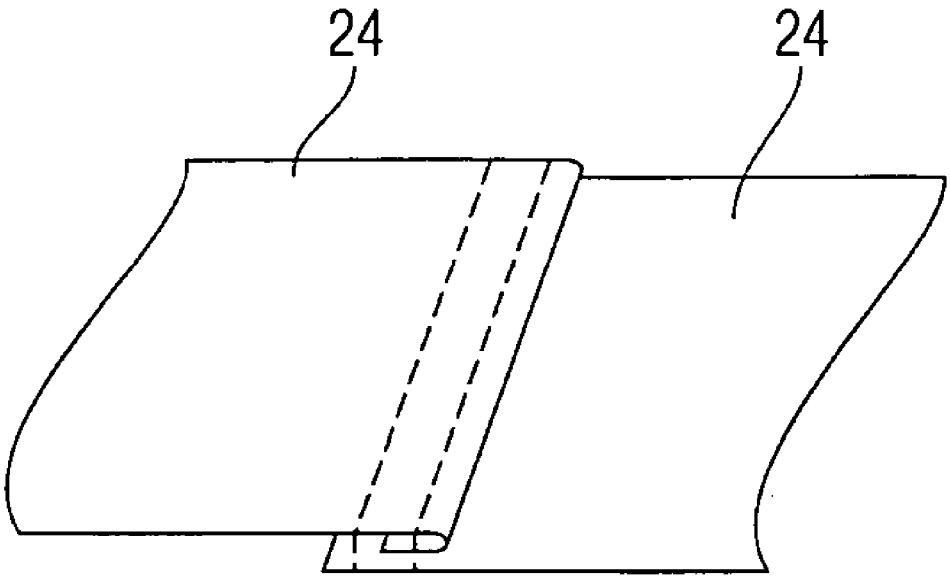
FIG. 20 is a diagrammatic view of an alternate stitch.

In manufacturing the mattress, the foam 12, the fire barrier material 20 and the ticking 14 are assembled in a single sheet which is large enough to form the respective planar surfaces of the top and bottom of the mattress. These are disposed on the frame. The sidewall 22 is usually formed from a single length of the assembled foam 12, fire barrier material 20 and ticking 14. The length of sidewall is placed around the frame and the top and bottom flanges are formed with the sidewall 22. The opposite ends 24, 24' of the sidewall 22 are overlapped and sewn together. FIGS. 8–10 and 20 show alternate overlapping seams which are recommended. These seams are made in accordance with ASTM D6193. FIG. 8 shows overlapping of the opposite ends 24, 24' of the sidewall and seaming with one or more rows of stitches. FIG. 9 shows the folding in and overlapping of the opposite ends 24, 24' of the sidewall so that the ends are concealed and seaming with one or more rows of stitching. FIG. 10 shows the overlapping of a strip of fire retardant material on the abutted opposite ends 24, 24' of the sidewalls and seaming with two or four rows of stitching. FIG. 20 shows the folding of the edge of a ply of the material and lapping it on another ply and seaming with two rows of stitching. Only one row of stitches passes through the turned outer edge. If the opposite ends 24, 24' of the sidewall 22 were simply butted together without any overlapping, the mattress would not withstand an open flame. The flame would ignite the foam 12 which would be exposed at the butted joint and the foam within the mattress 10 would burn. All of the overlapping seams are sewn with the flame retardant thread 18.

The quilted panel subassembly of the foam base, the fire barrier material and the ticking have a contiguous outer perimeter edge. The outer perimeter edges of the quilted panel subassembly, made up of foam base, fire barrier material, and ticking can have a thickness from 6 mm (0.025 in,) to 200 mm (8 in.) or higher. To enable the outer perimeter edge of the horizontal quilted panel subassembly, having the aforementioned thickness, to be joined to the vertical (sidewall) quilted panel assembly, having the aforementioned thickness, using the flame retardant tape and flame retardant sewing thread in accordance with the teachings of the present invention, requires that the thickness be compressed to a height of approximately 8 mm and overedge stitched (serged/serging), using a class 500 stitch as shown in ASTM D6193, Standard Practice for Stitches and Seams.

Prior to the enactment of California Assembly Bill 603, the outer perimeter could be serge stitched using a non-flame resistant thread, such as nylon, polyester, or polypropylene. However, when the tape edge is exposed to a flame impingement, these encapsulated non-flame retardant sewing threads will melt causing the compressed foam to immediately expand. This expansion increases the combustible fuel load sufficiently to cause seam failure and spread of the fire to the foam.

The present invention addresses the use of aramid thread (CRAQ-SPUN® threads made of aramid fibers) as the thread to be used to serge stitch (overedge stitch) the compressed outer perimeter edge of the quilted subassemblies. The inherent flame resistance of these fibers effectively retains the integrity of the compressed and serged stitch edge so that the foam stays compressed.

Figure 11A:
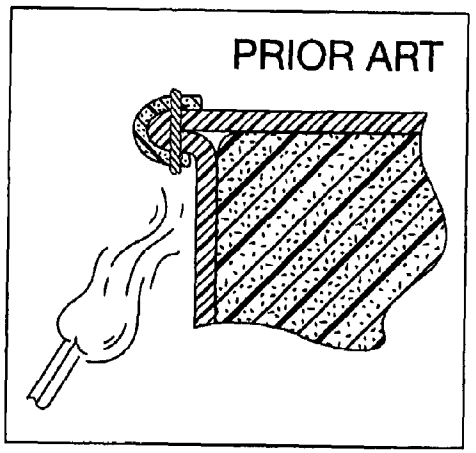
FIG. 11A has a cut-away view showing a flame applied to the prior art mattress.
Figure 11B:
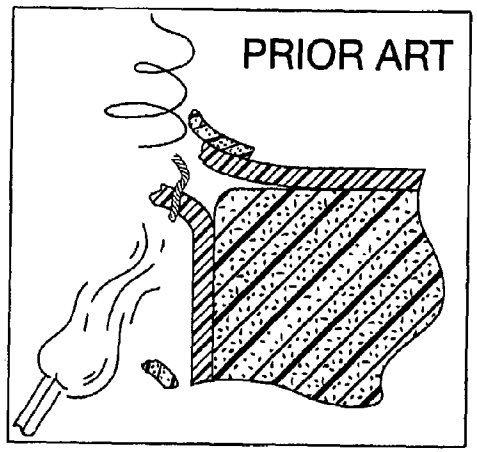
FIG. 11B has a cut-away view showing FIG. 11A and the stitching melted and the tape burning.
Figure 11C:
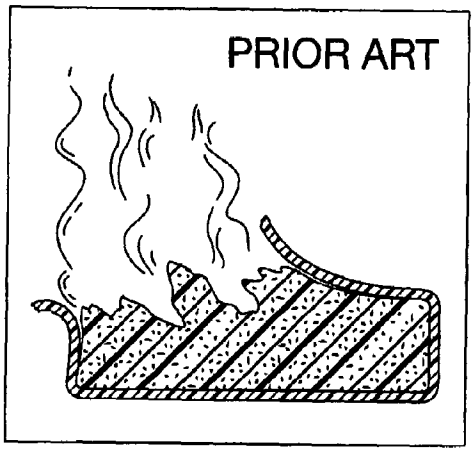
FIG. 11C has a cut-away view showing FIG. 11A with the entire mattress burning.
Figure 11D:
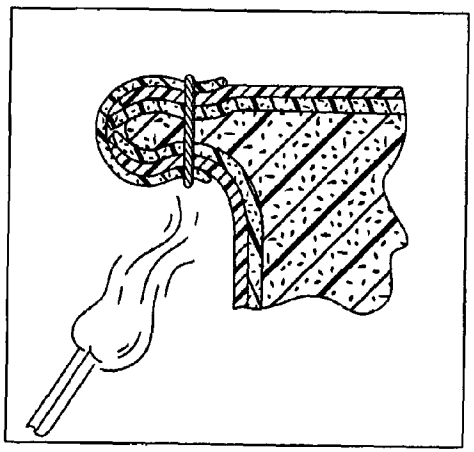
FIG. 11D is a cut-away view showing a flame applied to the present invention.
Figure 11E:
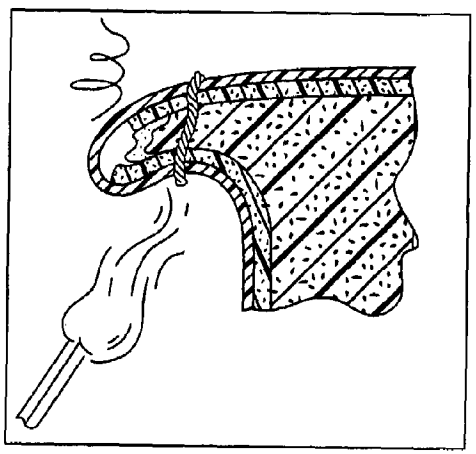
FIG. 11E is a cut-away view showing FIG. 11D retaining integrity after exposure to the open flame.

The effectiveness of the fire retardant properties of the present invention has been extensively tested against an open flame in accordance with California Technical Bulletin 129. This requires a methane flame at 1,200° F. which is much more severe than a burning match which burns at approximately 460° F. The continuous exposure time to the open flame is for three (3) minutes. After three (3) minutes, the ticking in the vicinity of the flame has been consumed or has melted. There is charring of the ticking around the outer areas which have been exposed to the flame. Also, charred remnants of the ticking cover the fire barrier material 20 (the aramid). The edge binding 10 is darkened and is somewhat embrittled, but is intact. The flame retardant thread 18 through the flange is unaffected and retains the flange in its original shape. The mattress successfully passed this vigorous test (FIGS. 11D–11E).

It was noted that after the open flame was removed, an after flame was occasionally observed on the flange, usually at the edges of the area exposed to the open flame. This was due to burning of the compressed foam which was in the flange. The after flame burned out in a short time and did not ignite adjacent portions of the flange nor did it ignite the foam within the mattress.

If the thread is made from a polymeric fiber, as is presently used in the contemporary non-fire retardant mattresses, it has been found that these polymeric fibers melt. The edge binding tape is not retained over the flange and the foam is ignited. The mattress does not withstand the open flame test when nylon thread is used, even with the fire barrier material and the treated edge binding (FIGS. 11A–11C).

Pillow top mattresses have a foam mattress member 30 and a foam pillow member 32 with a gusset 34 therebetween. Two-sided pillow top mattresses have two pillow members 32 on opposite faces of the mattress and two gussets are formed. The potential for ignition and combustion is greater for a pillow top mattress than for a non-pillow top mattress because of the increased surface area. This is still further increased for a two-sided pillow top mattress.

Figure 12:
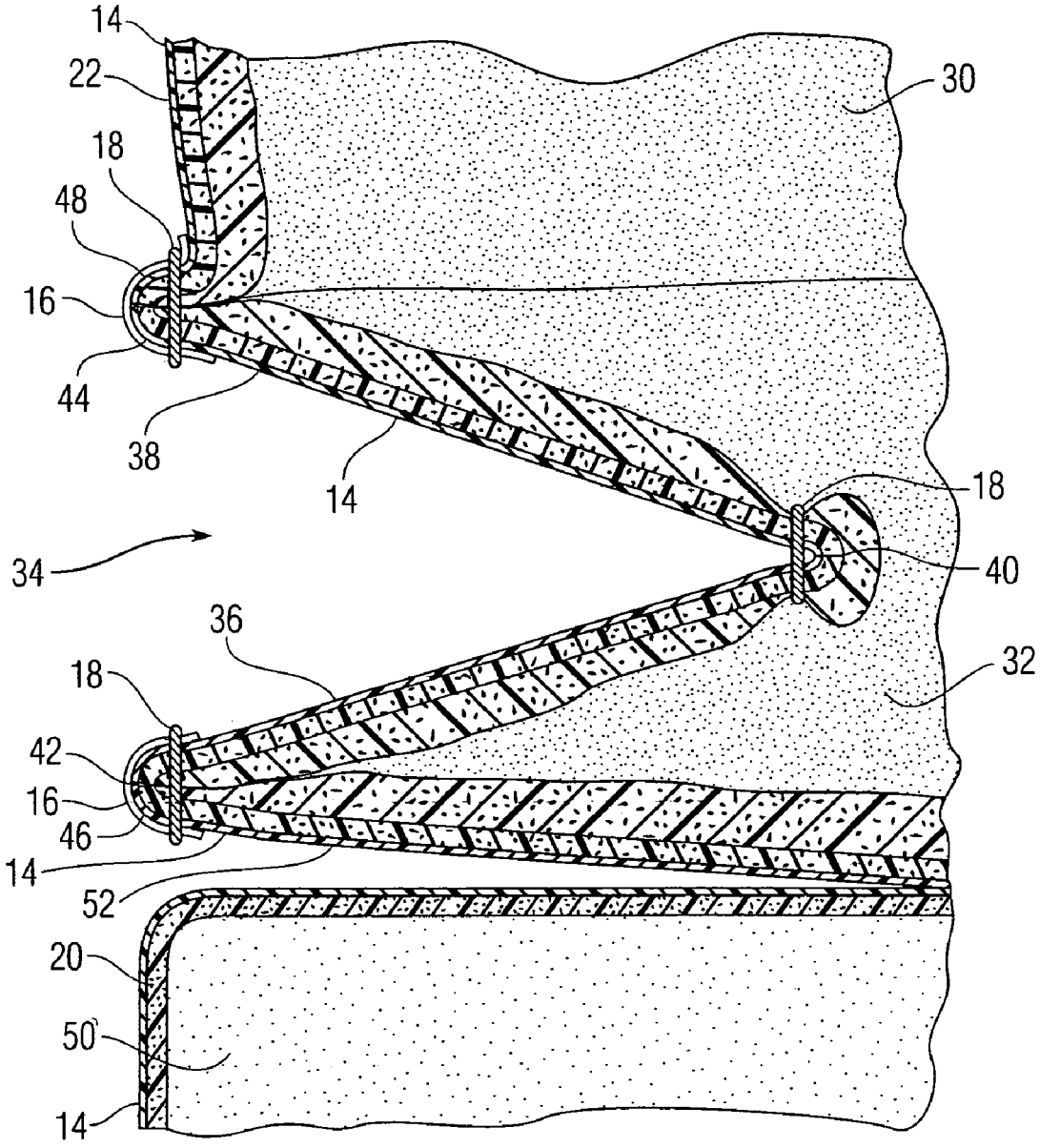
FIG. 12 is a partial cutaway view of the two-sided pillow top mattress resting on the foundation and showing the gusset.
Figure 13:
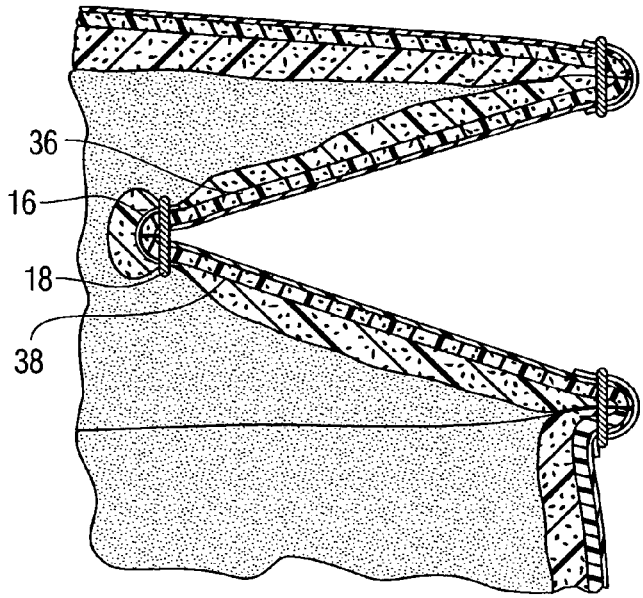
FIG. 13 is a partial cutaway view of the mattress showing the apex of the gusset.

As shown in FIG. 12 the gusset 34 has a first wall cover 36 and a second wall cover 38 formed from the ticking 14 and the fire barrier material 20. The walls 36, 38 are opposed to, and angularly disposed, with respect to one another. The walls 36, 38 form an apex 40 of the gusset 34. Preferably, the walls 36, 38 are a single, continuous piece of material which is folded at the apex 40 to reduce the possibility of ignition. The wall covers 36, 38 are secured by sewing with the flame retardant sewing thread 18. The sewing thread 18 pinches the wall covers 36, 38 together at the apex 40 and it is stitched.

The gusset wall covers 36, 38 each have a respective end 42, 44 distal from the apex 40 of the gusset 34. The end 42 of the first gusset wall 36 is joined to an outer end 46 of the ticking 14 covered fire barrier material which covers the pillow member 32. Treated flame retardant tape 16 for edge binding covers the joint formed from the end 42 of the first gusset wall 36 and the outer end 46 of the pillow cover. 52 The flame retardant sewing thread 18 secures the tape 16 over the joint.

In a similar manner, the end 44 of the second gusset wall cover 38 is joined to the peripheral edge of the fire barrier material which covers the sidewall 22 of the mattress member 30. Treated fire retardant tape 16 for edge binding covers the joint formed from the end of the second gusset wall and the sidewall 48 of the mattress member. The flame retardant sewing thread 18 secures the tape 16 over the joint.

If desired, the apex 40 may be covered with the treated fire retardant tape 16 for edge binding and the tape 16 may be secured over the apex 40 with flame-retardant sewing thread 18.

Figure 14:
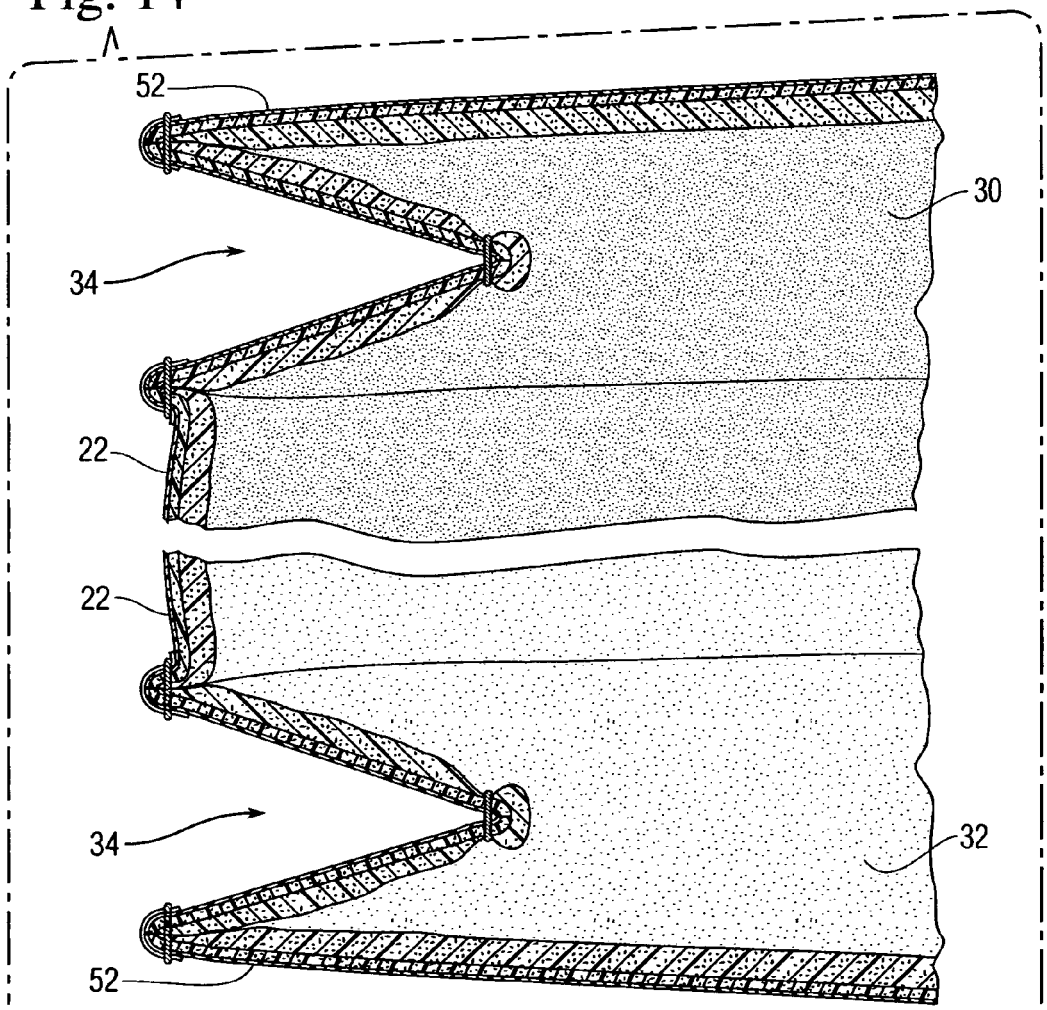
FIG. 14 is a cutaway view of a two-sided pillow top mattress.

As shown in FIG. 14, the two-sided pillow top mattress differs from the one-sided pillow top in that there are two gussets 34 which are separated by the sidewall 22 of the mattress and which extend circumferentially around the mattress. Each gusset is identical.

The gusset 34 may have a depth of approximately as much as six (6) inches from the mouth to the apex.

The pillow top of the mattress is disposed on a foundation 50 such as a box spring. There is a potential for a large opening to be formed at the interface because of the shape of the pillow top. This opening could be the source of spreading of a fire or of ignition of an unprotected area. To minimize this possibility and to increase the fire retardant protection, the foundation 50 is covered with fire barrier material 20 to a distance of 6–8 inches inwardly from the outer side of the foundation as shown in FIG. 12.

Figure 15:
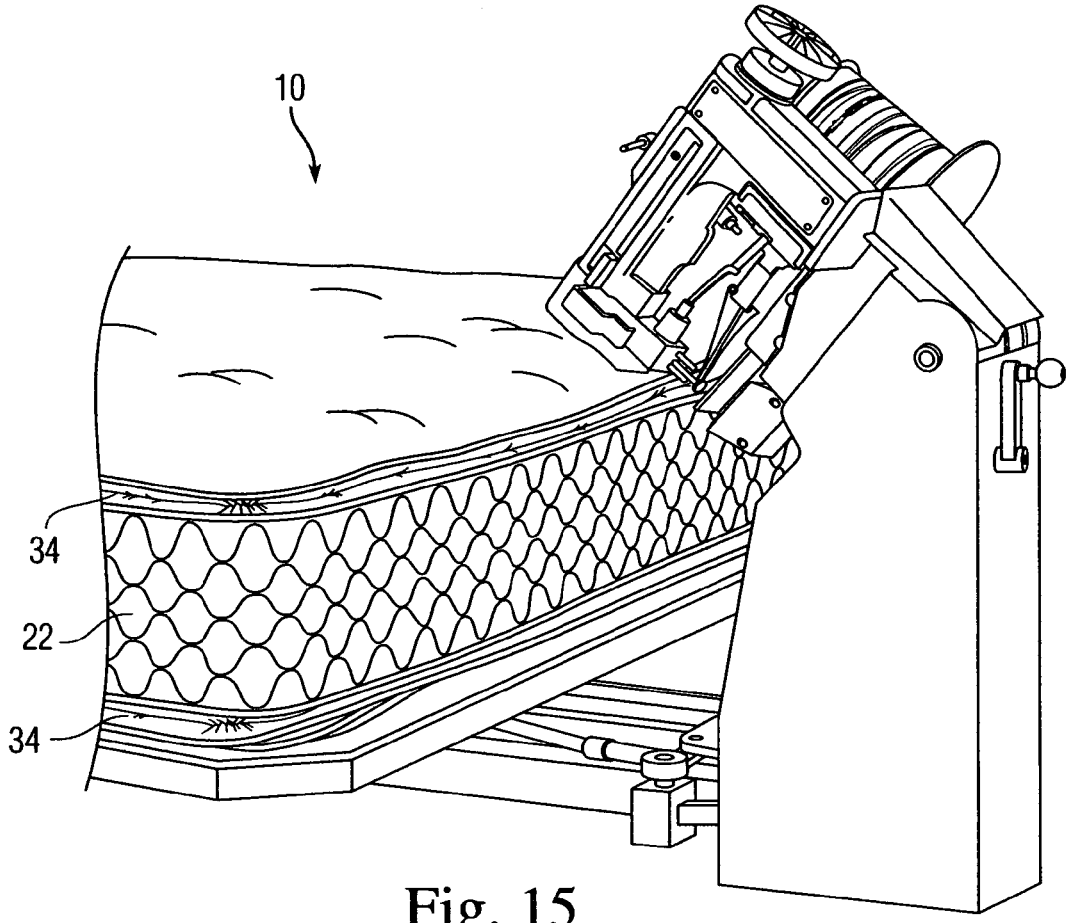
FIG. 15 is a perspective view of a two-sided pillow top mattress being sewed.
Figure 16:
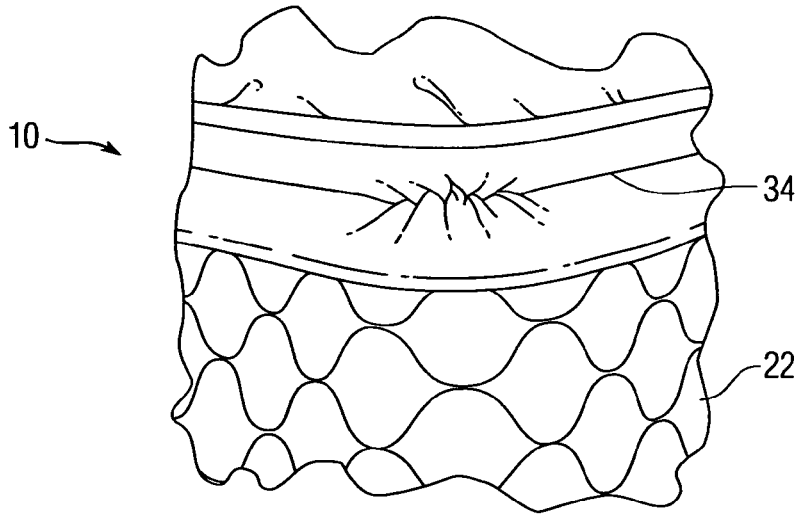
FIG. 16 is an enlarged perspective view of the gusset at the corner of the mattress.

The sewing of the outer edge of the cover with the end of the first gusset wall is shown in FIG. 15. An enlarged view of the gusset at a corner of the mattress is shown in FIG. 16.

It is preferred that the exterior fire barrier material be covered with a decorative ticking which may be quilted to a foam backing.

Figure 17:
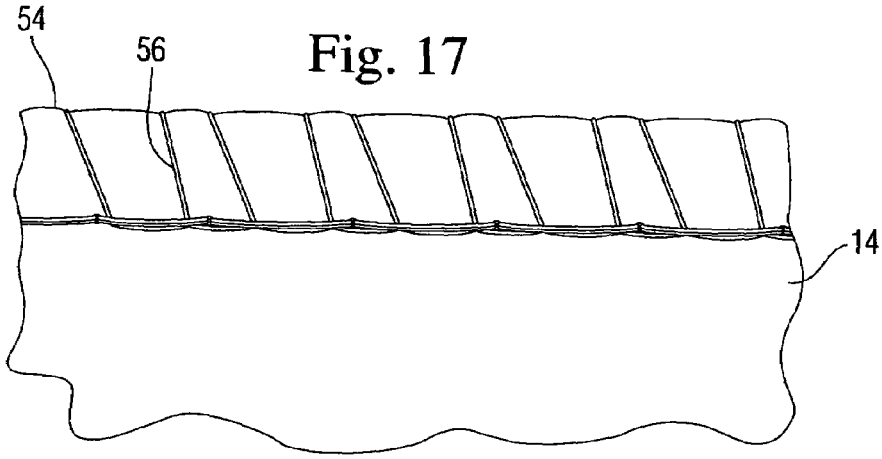
FIG. 17 is a side view of a portion of the sidewall showing the serging of the edge.
Figure 18:
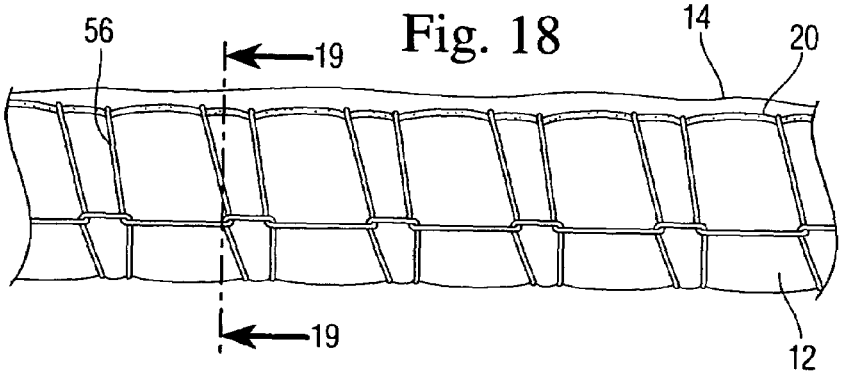
FIG. 18 is a top view of FIG. 17.
Figure 19:
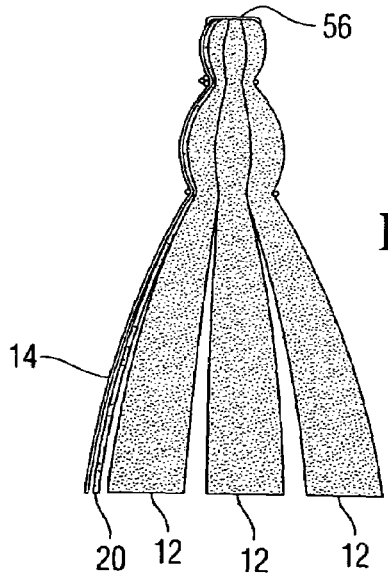
FIG. 19 is an end view of FIG. 17.

As shown in FIGS. 17–19, the outer perimeter edge of the contiguous edges of each of the foam base, the fire barrier material and the ticking are bound together by a serging stitch. The serge stitch alternately is called an over-edging stitch or an edge finish stitch. The serge stitch holds the components together and prevents unraveling of any sewn material. The serge stitch in the present invention is formed from a flame retardant sewing thread, preferably a thread formed from aramid fibers. In this manner, the serge stitch also provides increased fire retardancy to the mattress, since it will not ignite nor melt when exposed to an open flame and the perimeter edges do not open and permit spreading of fire through the foam of the mattress.

In a pillow top mattress, the serge stitch is formed in the gusset and sidewalls of the gusset in a manner as described above for the mattress.

In making the fire retardant mattress, the outer perimeter edge of the sheet of material formed from the ticking, the fire barrier material and the foam base is serge stitched with a flame retardant sewing thread.

The present invention is an overall system to encapsulate the foam which is in the mattress and to prevent the foam from burning. The system is the fire barrier material, the treated edge binding tape and the flame retardant thread (aramid) in which the three components are interdependent plus the serge stitching of the perimeter edges of the ticking, the fire barrier material and the foam. The system withstands an open flame and safeguards the structural integrity of the mattress to prevent ignition of the foam. The system acts as checks and balances. The present invention solves a long-standing problem which the mattress and furniture industry has recognized and has not resolved.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A system for a fire retardant mattress comprising a foam base, a fire barrier material substantially covering the foam base, a ticking covering the fire barrier material, a fire retardant tape forming an edge binding for the mattress around the perimeter thereof, the fire barrier material being sandwiched between the edge binding, thereby forming a laterally-projecting flange, and the flange being held together by a stitched flame retardant sewing thread; the thread and the tape of the edge binding being capable of withstanding very high temperatures without rendering the foam vulnerable to the flames, and yet retaining the structural integrity of the mattress as a whole, wherein the foam base is attached to the fire barrier material and is sandwiched between the edge binding together with the fire barrier material and forming the laterally-projecting flange; the foam base, the fire barrier material and the ticking each having an outer perimeter edge, the outer perimeter edges of the foam base, the fire barrier material and the ticking respectively being bound together by a serge stitching, the serge stitching being formed from a flame retardant sewing thread, wherein the foam base, which is flammable, is protected from exposure to an open flame by the system of the fire barrier material, the fire retardant tape, the flame retardant sewing thread and the serge stitching formed from the flame retardant sewing thread.

2. The system of claim 1, wherein the flame retardant sewing thread is formed from aramid fibers.

3. The system of claim 1, further comprising the mattress having a pillow top having a gusset, the pillow top and gusset having the ticking, the fire barrier material, the fire retardant tape and the flame retardant sewing thread, and the serge stitching formed from the flame retardant sewing thread.

4. A method of making a fire retardant mattress comprising the steps of:

providing a foam base forming a mattress member, providing a fire barrier material, a flammable foam interiorly adjacent to the fire barrier material and a ticking exteriorly covering the fire barrier material thereby forming a sheet of material, the sheet of material having an outer perimeter edge, providing a flame retardant sewing thread, serge stitching the outer perimeter edge of the sheet of material with the flame retardant sewing thread, forming the sheet of material into a cover for the mattress member and into sidewalls for encircling the mattress member, providing a treated fire retardant tape, mating an edge of the sidewall with the outer perimeter edge of the sheet of material, covering the mated edges having the foam compressed therebetween with the treated fire retardant tape, securing the covered mated edges with the flame retardant sewing thread, wherein the entire mattress is covered with the fire barrier material and all joined and mated edges are secured with the flame retardant sewing thread such that the foam base is protected from exposure to flame.

* * * * *